United States Patent [19]

Dodson et al.

[11] 4,206,061

[45] Jun. 3, 1980

[54] FIRE RESISTANT GREASE

[75] Inventors: Stanley C. Dodson, Leatherhead; Christopher M. Elliott, Twickenham, both of England

[73] Assignee: The British Petroleum Company Limited, London, England

[21] Appl. No.: 880,137

[22] Filed: Feb. 22, 1978

[30] Foreign Application Priority Data

Mar. 8, 1977 [GB] United Kingdom ..... 9672/77

[51] Int. Cl.[2] ..... C10M 7/44; C10M 7/28; C10M 7/04

[52] U.S. Cl. ..... 252/29; 252/49.8

[58] Field of Search ..... 252/29, 49.8

[56] References Cited

U.S. PATENT DOCUMENTS 3,384,583 5/1968 Groszek et al. ..... 252/29

3,532,625 10/1970 Groszek et al. ..... 252/29

3,634,246 1/1972 Quaal ..... 252/29

*Primary Examiner*—Irving Vaughn

*Attorney, Agent, or Firm*—Morgan, Finnegan, Pine, Foley & Lee

[57] ABSTRACT

A fire-resistant grease comprises a fire-resistant base oil and graphitic carbon or oleophilic graphite as a thickener. Suitable base oils include fire-resistant hydraulic fluids, particularly phosphorus acid esters or amides and more particularly trihydrocarbyl phosphates. The graphitic carbon may be of the type described in U.K. Pat. No. 1,252,582 (U.S. Pat. No. 3,532,625) and the oleophilic graphite as described in U.K. Pat. No. 1,168,784 (U.S. Pat. No. 3,384,583). The thickener contact may be 1–20% wt of the grease, preferably 2–10% wt, and the grease may contain conventional additives.

4 Claims, No Drawings

FIRE RESISTANT GREASE

This invention relates to a fire-resistant grease.

There is current interest in fire-resistant greases for lubricating bearings and other moving surfaces in mines but such greases may be useful in any other areas where fire is a hazard. Ordinary mineral lubricating base oils can obviously not be used for such greases. A convenient starting point for fire-resistant greases may be to use, as the liquid base oil, a type of oil normally used in fire-resistant hydraulic fluids. Most conventional grease thickeners are reasonably fire-resistant, but there are, nevertheless, practical difficulties in preparing fire-resistant greases using a fire-resistant fluid as base oil, particularly when the nature of the thickener requires the use of relatively high temperatures to make the grease.

Our U.K. Pat. No. 1,252,582 (U.S. Pat. No. 3,532,625) describes and claims a grease composition which comprises a lubricating base oil thickened to a grease consistency by a substantially non-hydrophilic graphitic carbon having a surface area measured by nitrogen adsorption of at least 170 square meters per gram, a ratio of heat adsorption of n-dotriacontane from n-heptane to heat of adsorption of n-butanol from n-heptane of at least 3.5:1 and a heat of adsorption of n-dotriacontane from n-heptane of at least 1 calorie per gram.

It has now been found that the graphitic carbon thickeners of the above patent are particularly suitable for fire resistant greases.

According to the present invention a fire-resistant grease composition comprises a base oil thickened to a grease consistency by (a) a substantially non-hydrophilic graphitic carbon having a surface area measured by nitrogen adsorption of at least 170 square meters per gram, a ratio of heat of adsorption of n-dotriacontane from n-heptane to heat of adsorption of n-butanol from n-heptane of at least 3.5:1 and a heat of adsorption of n-dotriacontane from n-heptane of at least 1 calorie per gram, or (b) an oleophilic graphite, as hereinafter defined, characterised in that the base oil is a fire-resistant base oil.

The fire-resistant base oil may be any of the fire-resistant oils known for use as hydraulic fluids. The preferred base oils are esters or amides of phosphorus acids, particularly phosphate esters, and more particularly the trihydrocarbyl phosphates. The hydrocarbyl portions of the ester may be aryl, alkyl or a mixture of alkyl and aryl and may have from 3 to 15 carbon atoms. Tri(alkylaryl) phosphates may be particularly suitable. An example of such a material is sold under the name Coalite NTP. The term "NTP" stands for Non-Toxic Phosphate and low toxicity is another desirable characteristic of the base oil.

Other fire-resistant base oils may be halogenated hydrocarbons e.g. chlorinated biphenyls, hexachlorobutadiene, chlorinated paraffins, and chlorofluoro hydrocarbons, but there may be environmental objections to the use of at least some of these materials.

The base oils may have viscosities of from 1 to 30 centistokes at 100° C., viscosity indices of from 0 to 150, flash points of above 200° C., and autogeneous ignition temperatures above 315° C.

Suitable tests for fire-resistance of the base oil may be found in NCB Specification 570/1970, ASTM Method D3119-72T and SAE Specification AMS 3150C, and the term fire-resistant base oil means an oil passing at least one of these tests.

The graphitic carbon may have the preferred characteristics described in U.K. Pat. No. 1,252,582 (U.S. Pat. No. 3,532,625). Thus, the surface area of the graphitic carbon is preferably at least 600 square meters per gram, and more preferaby at least 1000 square meters per gram.

Preferably the graphitic carbon has a heat of adsorption of n-dotriacontane from n-heptane of at least 2.0 calories per gram and more preferably at least 3 calories per gram. The graphitic carbon preferably also has a ratio of heat of adsorption of n-dotriacontane from n-heptane to heat of adsorption of n-butanol from n-heptane of at least 5:1.

The graphitic carbon preferably has a sulphur content of less than 0.8% more preferably less than 0.1% and most preferably less than 0.5% by weight. Preferably the graphitic carbon comprises at least 85% wt carbon.

By substantially non-hydrophilic is meant that the graphitic carbon has little affinity for distilled water, and it is difficult to wet with distilled water. When the graphitic carbon is shaken with distilled water there is a marked tendency for the graphitic carbon to separate out after the shaking has ceased.

Preferably the graphitic carbon is substantially free from water and from volatile components. By volatile components is meant compounds having an initial boiling point of below 350° C. preferably below 300° C.

The volatile components can be removed by heating the contaminated graphitic carbon to at least 300° C. preferably at least 350° C. under normal pressure. Alternatively, the volatile compounds can be removed by heating under reduced pressure, e.g. below 1 mm of mercury at above 50° C. preferably above 100° C.

The graphitic carbon can be prepared by partially burning a hydrocarbon in oxygen or an oxygen containing gas at an elevated temperature so that not more than 10% by weight of the carbon in the hydrocarbon is released as elemental carbon and treating the products of the combustion to separate therefrom the graphitic carbon.

The heats of adsorption of n-dotriacontane and n-butanol can be measured using a flow microcalorimeter as described in Chemistry and Industry Mar. 20, 1965 pp. 482–489.

Graphite crystals are thought to possess two different types of 'sites', referred to hereinafter as 'oleophilic sites' and 'polar sites'. The oleophilic sites are present on the basal plane area of graphite crystals and the polar sites are present on the edge area of graphite crystals. The oleophilic sites adsorb long chain paraffinic hydrocarbons and the polar sites adsorb polar compounds, the two types of adsorption being essentially independent. The grease thickening properties of graphite crystals result from their ability to adsorb strongly the long chain molecules present in the lubricating base oil. In order to enable a suitable stable graphite structure to be built up it is important that the proportion of basal plane sites be as large as possible, i.e. each graphite crystal should have a high ratio of basal plane to edge area.

The relative amount of basal plane area present is readily shown from heat of adsorption measurements, the heat of adsorption of n-dotriacontane being indicative of the amount of basal plane area and the heat of adsorption of n-butanol being indicative of the amount of edge area. Thus a high heat of adsorption of n-dotriacontane coupled with a low heat of adsorption of n-butanol is characteristic of a graphite having a relatively high proportion of basal plane surface which is oleophilic and consequently is a good thickening agent.

The heat of adsorption of n-dotriacontane from n-heptane can be as high as 7.5 calories per gram or even higher in particularly preferred products.

A particularly suitable graphitic carbon is that sold by Akzo Chemie U.K. Limited under the trade name Ketjenblack EC.

Other materials analogous to graphitic carbon in having a relatively high ratio of heat of adsorption of n-dotriacontane from n-heptane to heat of adsorption of n-butanol from n-heptane are the so-called "oleophilic" graphites, which are defined as graphites produced by grinding graphite below the surface of an organic liquid which distils below 500° C. till a surface area of 20 to 800 $m^2/g$ is obtained. Such oleophilic graphites are described and claimed in U.K. Pat. No. 1,168,785 and greases thickened with such oleophilic graphites are described and claimed in U.K. Pat. No. 1,168,784. Oleophilic graphite-metal mixtures are described and claimed in U.K. Pat. No. 1,292,818. Oleophilic graphites and oleophilic graphite metal mixtures may have ratios of the heat of adsorption of n-dotriacontane from n-heptane to the heat of adsorption of n-butanol from n-heptane of at least 3.5:1 and the surface areas are usually from 30 to 200 $m^2/g$.

A particular advantage of the combination of base oil and thickener used is that they can be mixed at atmospheric temperature with stirring. Preferably the final stage of the mixing is in a colloid mill or homogeniser, e.g. a Manton-Gaulin homogeniser. Any risk of volatilisation or degradation of the base oil is thus obviated.

Another advantage is that greases of suitable penetration can be produced using relatively small amounts of thickener. The amount may be from 1 to 20% wt of the grease, but usually the amount will be from 2 to 10% wt.

The grease may contain any of the conventional additives, e.g. anti-corrosion agents, anti-oxidants, load-carrying additives, and V.I improvers and these may be added at any convenient stage. The graphitic carbon is believed to thicken by bonding across the large non-polar basal plane area of the graphite rather than the small polar edge area, so the thickening power is not affected by conventional additives despite the fact that most of them are polar. Graphites with large polar edge areas tend to bond across these areas and are incompatible with polar additives.

The greases may have penetrations of from 220 to 460 at 25° C. and a dropping point greater than 250° C.

The fire-resistance of the greases may be determined by a number of tests, e.g. gauze tests (where the flammability of a layer of grease on a gauze is evaluated), fire point and flash point tests, and spontaneous ignition tests on a hot plate.

The invention is illustrated by the following examples:

EXAMPLE 1

A grease was prepared by mixing
92.9%: tri(alkylaryl) phosphate
6.3% wt: graphitic carbon
0.8% wt: rust inhibitor The tri(alkylaryl) phosphate was the material sold by Coalite and Chemical Products Limited under the name "Coalite NTP".

The graphitic carbon was that soid by Akzo Chemie U.K. Limited under the name Ketjenblack EC. It had a BET surface area of $1000m^2/g$, a heat of adsorption of n-dotriacontane from n-heptane of 7.2 calories/g, a heat of adsorption of n-butanol from n-heptane of 0.1 calories/g and hence a ratio of heats of adsorption of 72.

The rust inhibitor was an ethylene diamine succinimide sold by Edwin Cooper & Co. Ltd. under the name Hitec E536.

The grease was prepared as follows. 5,574 g of Coalite NTP were mixed with 48 g of Hitec E536 in a Hobart mixer for 30 mins at room temperature. Ketjenblack EC was added slowly and stirred for three hours until thickening occurred. The grease was milled in a Premier Colloid Mill at 0.002 inch gap and deaerated. A smooth, black, glossy grease was obtained with a penetration of 274 (worked 60 strokes).

The grease was submitted to the following tests with the following results.

| | Rating | Comments |
|---|---|---|
| IP220 Corrosion Test | 0 | Good protection against rusting |
| IP168 Bearing Test (7,000 rpm 120° C.) | All ratings 1 | Good performance |
| R.HP High Speed No. 2 Test | Pass | Unusually good performance for NLGI 2 grease |
| IP215 Water Washout (% wt) | 0.25 | Very good performance |

In tests for fire-resistance, the grease was classified as "burning with difficulty" in a gauze test, and did not ignite even at 650° C. in a spontaneous ignition test on a hot plate.

EXAMPLE 2

A grease was prepared by mixing
94.6% wt: tri(alkylaryl) phosphate
5.0% wt: graphitic carbon
0.4% wt: rust inhibitor The tri(alkylaryl) phosphate was the material sold by Ciba-Geigy Limited under the name "HYD 110". The graphitic carbon was Ketjenblack EC sold by Akzo Chemie U.K. Limited. The rust inhibitor was an ethylene diamine succinimide, Hitec E536, sold by Edwin Cooper & Co. Ltd.

3,784 g of HYD 110 were mixed with 16 g of Hitec E536 at room temperature using a Silverson High Shear mixer. 200 g Ketjenblack EC were added gradually and well mixed. The thickened fluid was milled in a metal cone mill at 0.005 inch gap and a smooth, black, glossy grease of penetration (worked 60 strokes) 303 was obtained. The following test results on the grease were obtained.

| | Rating | Comments |
|---|---|---|
| IP220 Corrosion Test | 0 | Good protection against rusting |
| SKF 'A' Bearing Test | All ratings 1, apart from oil separation rating 2 | Good performance |

We claim:

1. A fire-resistant grease composition consisting essentially of a fire-resistant base oil having a viscosity of from 1 to 30 centistokes at 100° C., a viscosity index of from 0 to 150, a flash point of above 200° C. and an autogeneous ignition temperature of above 315° C., and a thickener for said base oil which is a substantially non-hydrophilic graphitic carbon having a surface area measured by nitrogen adsorption of at least 170 square meters per gram, a ratio of heat adsorption of n-dotriacontane from n-heptane to heat of adsorption of n-butanol from n-heptane of at least 3.5:1 and heat of adsorption of n-dotriacontane from n-heptane of at least 1 calorie per gram, wherein said graphitic carbon thickener is present in an amount of from 2 to 10% by weight of the grease.

2. The fire-resistant grease composition as claimed in claim 1 wherein the fire-resistant base oil is a trihydrocarbyl phosphate each hydrocarbyl group having from 3 to 15 carbon atoms.

3. The fire-resistant grease composition as claimed in claim 1 having a penetration of from 220 to 460 at 25° C. and a dropping point greater than 250° C.

4. The fire-resistant grease composition as claimed in claim 1 wherein said base oil is a hydraulic fluid.

* * * * *